US008292679B2

(12) United States Patent
Kuriyagawa et al.

(10) Patent No.: US 8,292,679 B2
(45) Date of Patent: Oct. 23, 2012

(54) OUTBOARD MOTOR CONTROL APPARATUS

(75) Inventors: Koji Kuriyagawa, Saitama (JP); Hajime Yoshimura, Saitama (JP); Hikaru Ikeda, Saitama (JP); Yoshiyuki Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 243 days.

(21) Appl. No.: 12/580,745

(22) Filed: Oct. 16, 2009

(65) Prior Publication Data

US 2010/0099311 A1 Apr. 22, 2010

(30) Foreign Application Priority Data

Oct. 20, 2008 (JP) ..... 2008-270214

(51) Int. Cl.
*B60W 10/04* (2006.01)
*B63H 21/21* (2006.01)
*B63H 20/14* (2006.01)
*F16H 61/58* (2006.01)

(52) U.S. Cl. ..... 440/86; 440/87; 440/84; 440/75; 477/62

(58) Field of Classification Search ..... 440/84, 440/86, 1, 75, 87; 123/41.44, 41.47; 477/54, 477/62, 83, 84, 110, 111
See application file for complete search history.

(56) References Cited

U.S. PATENT DOCUMENTS 4,558,769 A * 12/1985 Neisen ..... 192/3.31
4,887,984 A 12/1989 Newman
5,095,776 A 3/1992 Sato
5,199,326 A * 4/1993 Iwatsuki et al. ..... 477/98
5,336,120 A 8/1994 Maurer et al.
5,754,969 A * 5/1998 Ando et al. ..... 701/67
6,095,117 A * 8/2000 Minowa et al. ..... 123/399
6,481,390 B1 * 11/2002 Robb ..... 123/41.44
6,513,463 B2 * 2/2003 Katayama ..... 123/41.29
6,520,147 B1 * 2/2003 Kanno ..... 123/339.23
6,644,933 B2 * 11/2003 Light et al. ..... 417/223
6,695,743 B2 * 2/2004 Tanaka et al. ..... 477/98
6,709,302 B2 * 3/2004 Yanagihara ..... 440/1
6,884,133 B2 * 4/2005 Ishii ..... 440/89 H (Continued)

FOREIGN PATENT DOCUMENTS

EP 1 860 347 A2 11/2007

(Continued)

*Primary Examiner* — Lars A Olson
*Assistant Examiner* — Andrew Polay
(74) *Attorney, Agent, or Firm* — Carrier Blackman & Associates, P.C.; William D. Blackman; Joseph P. Carrier

(57) ABSTRACT

In an apparatus for controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump connected to the drive shaft to be driven by the drive shaft, and a shift mechanism interposed between the drive shaft and the propeller, comprising a neutral position detector that detects the shift mechanism being set in a neutral position; and a clutch ON unit that makes the lockup clutch ON to increase operation speed of the water pump when it is detected that the shift mechanism is set in the neutral position. With this, it becomes possible to improve cooling performance, thereby preventing a defect such as overheat of the engine.

13 Claims, 5 Drawing Sheets

U.S. PATENT DOCUMENTS

| | | | | |
|---|---|---|---|---|
| 6,899,575 | B1 * | 5/2005 | Rothe et al. | 440/39 |
| 7,121,233 | B2 * | 10/2006 | Kitamura et al. | 123/27 R |
| 7,214,164 | B2 * | 5/2007 | Shomura et al. | 477/113 |
| 7,578,713 | B2 | 8/2009 | Miyata et al. | |
| 7,704,183 | B2 * | 4/2010 | Nakamura et al. | 475/312 |
| 7,744,435 | B2 * | 6/2010 | Ide et al. | 440/75 |
| 2005/0230207 | A1 | 10/2005 | Tsunekawa | |
| 2007/0293103 | A1 | 12/2007 | Kinoshita et al. | |

FOREIGN PATENT DOCUMENTS

| | | | |
|---|---|---|---|
| JP | 0 430 675 | A2 | 6/1991 |
| JP | 03-172667 | A | 7/1991 |
| JP | 2000-055186 | A | 2/2000 |
| JP | 2002-161773 | A | 6/2002 |
| JP | 2007-315498 | A | 12/2007 |
| WO | 2007/007707 | A1 | 1/2007 |

* cited by examiner

OUTBOARD MOTOR CONTROL APPARATUS

BACKGROUND OF THE INVENTION

1. Field of the Invention

This invention relates to an outboard motor control apparatus, particularly to an apparatus for controlling an outboard motor having a torque converter.

2. Description of the Related Art

In recent years, there is proposed an outboard motor having a torque converter interposed between an internal combustion engine and drive shaft to amplify output torque of the engine and then transmit it to the drive shaft for enhancing acceleration performance, etc., as taught, for example, by Japanese Laid-Open Patent Application No. 2007-315498 ('498).

Generally an outboard motor is equipped with a water pump driven by a drive shaft for cooling an engine. However, in the case where the torque converter is provided between the engine and drive shaft as in the reference, the driveshaft is rotated at relatively low speed when a shift mechanism is in the neutral position and it causes insufficient rotation speed for driving the water pump. It may disadvantageously result in a defect such as overheat of the engine.

SUMMARY OF THE INVENTION

An object of this invention is therefore to overcome the foregoing drawback by providing an apparatus for controlling an outboard motor having a torque converter, which apparatus can improve cooling performance, thereby preventing a defect such as overheat of an engine.

In order to achieve the object, this invention provides an apparatus for controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump that is connected to the drive shaft to be driven by the drive shaft, and a shift mechanism interposed between the drive shaft and the propeller, comprising a neutral position detector that detects the shift mechanism being set in a neutral position, and a clutch ON unit that makes the lockup clutch ON to increase operation speed of the water pump when it is detected that the shift mechanism is set in the neutral position.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

A preferred embodiment of an outboard motor control apparatus according to the invention will now be explained with reference to the attached drawings.

Figure 1:
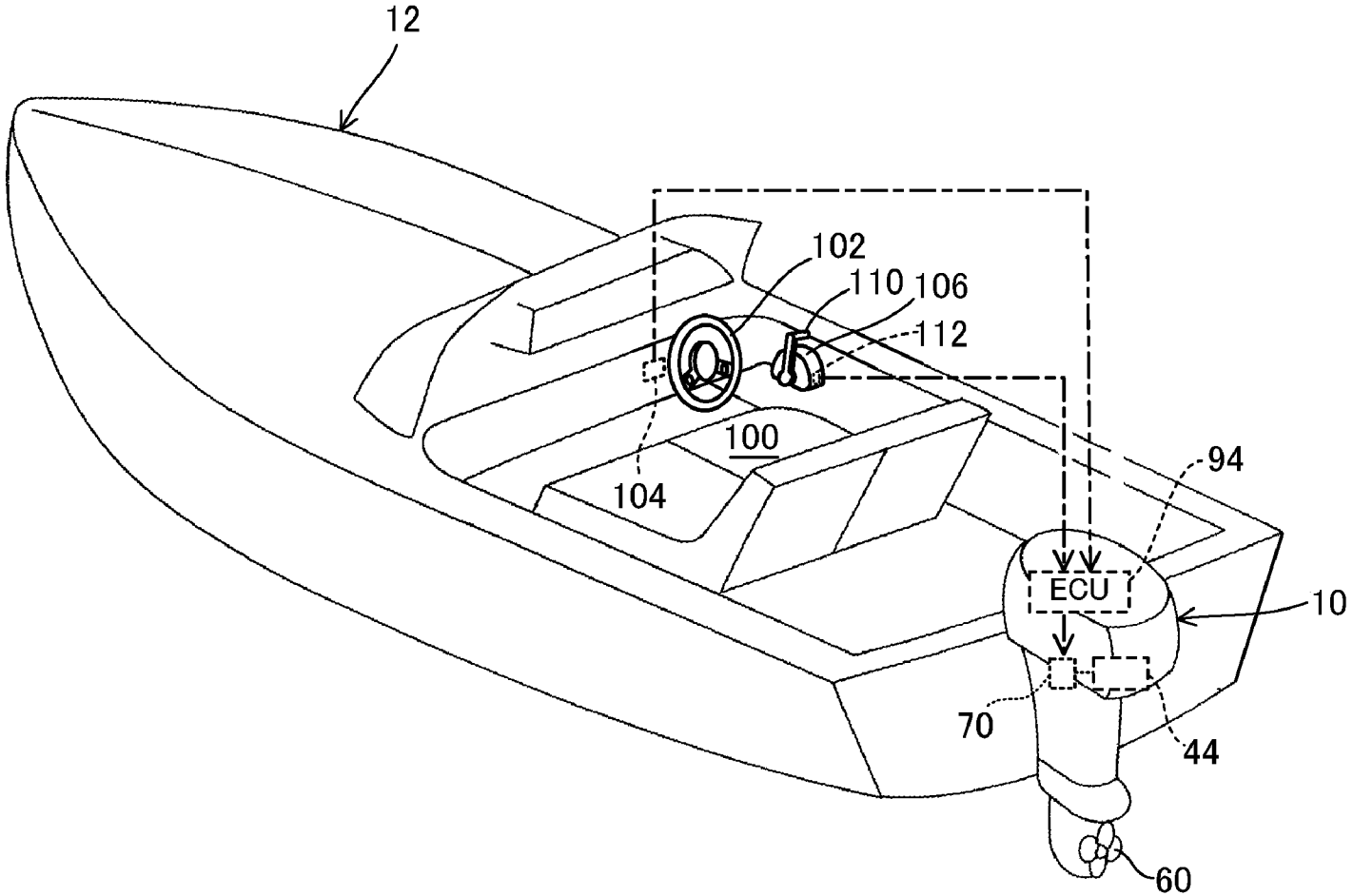
FIG. 1 is an overall schematic view of an outboard motor control apparatus including a boat (hull) according to an embodiment of the invention.
Figure 2:
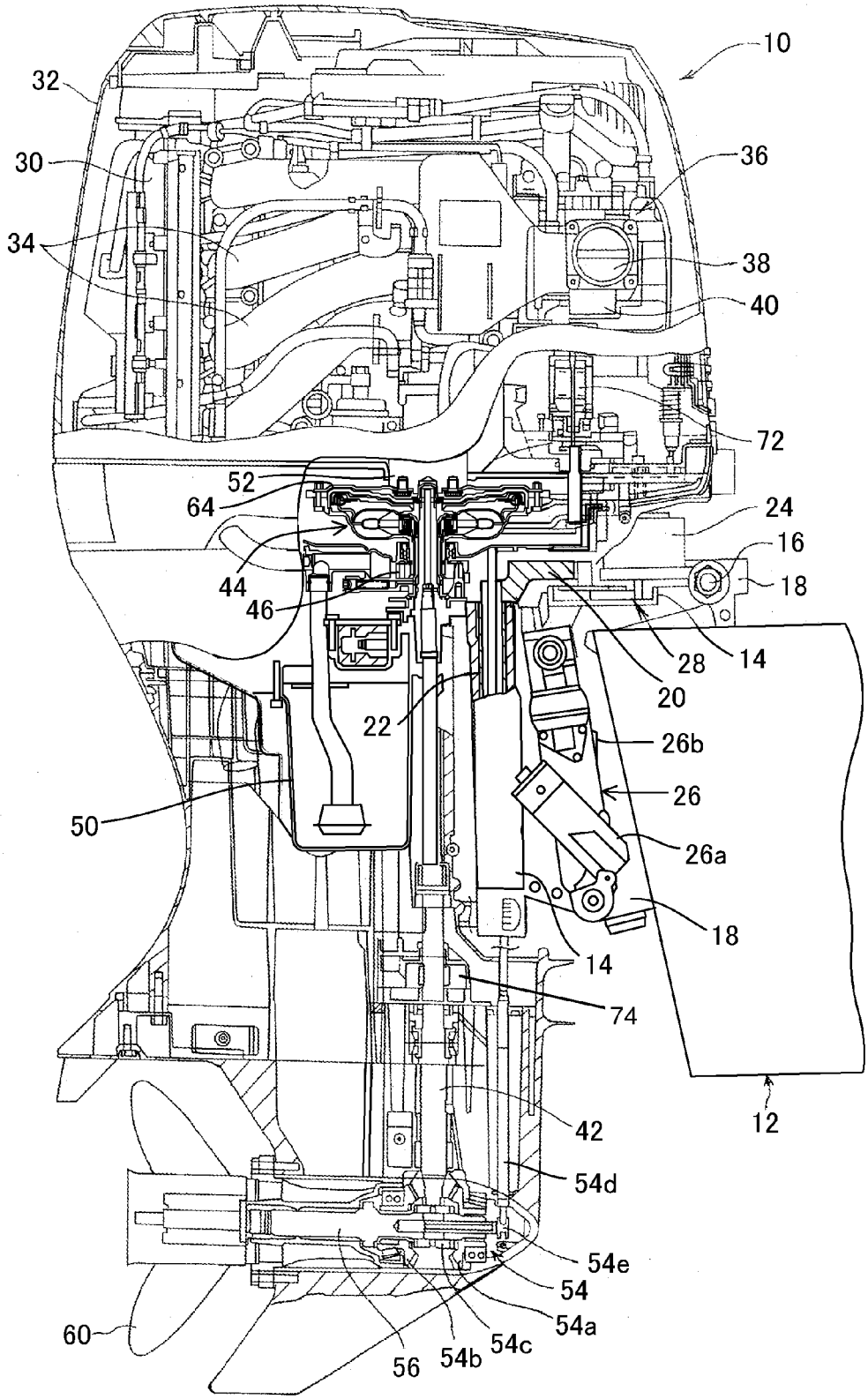
FIG. 2 is a sectional side view partially showing the outboard motor shown in FIG. 1.

FIG. 1 is an overall schematic view of an outboard motor control apparatus including a boat (hull) according to an embodiment of the invention. FIG. 2 is a sectional side view partially showing the outboard motor shown in FIG. 1 and FIG. 3 is an enlarged side view of the outboard motor.

Figure 3:
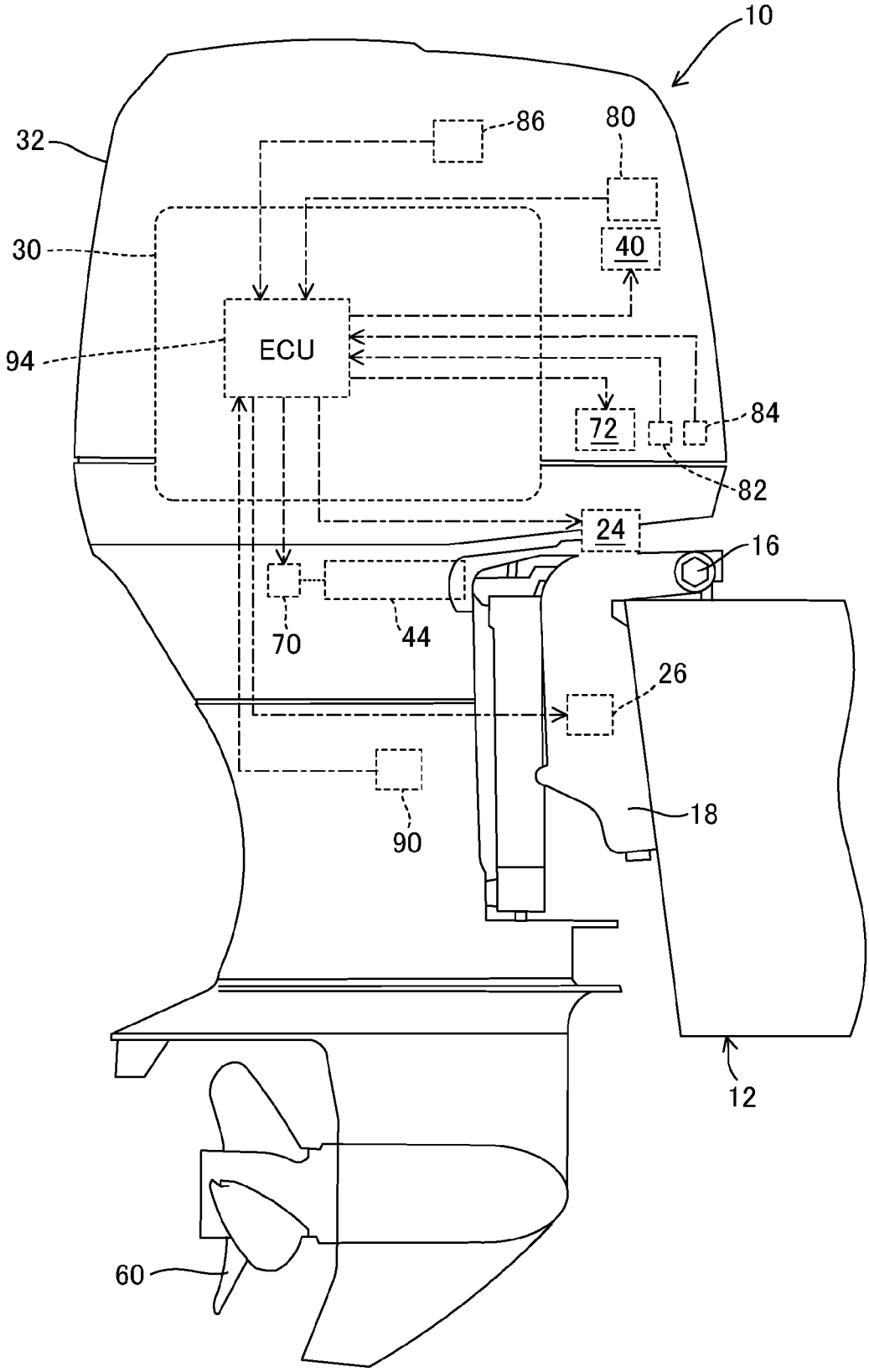
FIG. 3 is an enlarged side view of the outboard motor shown in FIG. 1.

In FIGS. 1 to 3, a symbol 10 indicates an outboard motor. As illustrated, the outboard motor 10 is clamped (fastened) to the stern or transom of a boat (hull) 12.

As shown in FIG. 2, the outboard motor 10 is fastened to the boat 12 through a swivel case 14, tilting shaft 16 and stern brackets 18. The outboard motor 10 is equipped with a mount frame 20 and shaft 22. The shaft 22 is housed in the swivel case 14 to be rotatable about the vertical axis such that the outboard motor 10 can be rotated about the vertical axis relative to the boat 12. The mount frame 20 is fixed at its upper end and lower end to a frame (not shown) constituting a main body of the outboard motor 10.

An electric steering motor (actuator) 24 for operating the shaft 22 and a power tilt-trim unit 26 for regulating a tilt angle and trim angle of the outboard motor 10 are installed near the swivel case 14. The output shaft of the steering motor 24 is connected to the upper end of the mount frame 20 via a speed reduction gear mechanism 28. Specifically, a rotational output of the steering motor 24 is transmitted to the mount frame 20 via the speed reduction gear mechanism 28, whereby the outboard motor 10 is steered about the shaft 22 as a steering axis to the right and left directions (steered about the vertical axis).

The power tilt-trim unit 26 integrally comprises a hydraulic cylinder 26*a* for adjusting the tilt angle and a hydraulic cylinder 26*b* for adjusting the trim angle. When the hydraulic cylinders 26*a*, 26*b* are extended and contracted, the swivel case 14 is rotated about the tilting shaft 16 as a rotational axis, thereby tiling up/down and trimming up/down the outboard motor 10.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown) disposed near the throttle body 36. The throttle motor 40 is operated to open and close the throttle valve 38, thereby regulating the flow rate of the air sucked in the engine 30 to control the engine speed.

The outboard motor 10 further comprises a drive shaft (vertical shaft) 42 installed parallel with the vertical axis to be rotatably supported, a torque converter 44 interposed between the engine 30 and drive shaft 42, a hydraulic pump 46 that is attached to the drive shaft 42 and pumps operating oil to a lubricated portion of the engine 30, the torque converter 44 and the like, and a reservoir 50 for reserving the operating oil.

The upper end of the drive shaft 42 is connected to a crankshaft 52 of the engine 30 through the torque converter 44 and the lower end thereof is connected via a shift mechanism 54 with a propeller shaft 56 supported to be rotatable about the horizontal axis. One end of the propeller shaft 56 is attached with a propeller 60. Thus the drive shaft 42 connects the engine 30 with the propeller 60.

Figure 4:
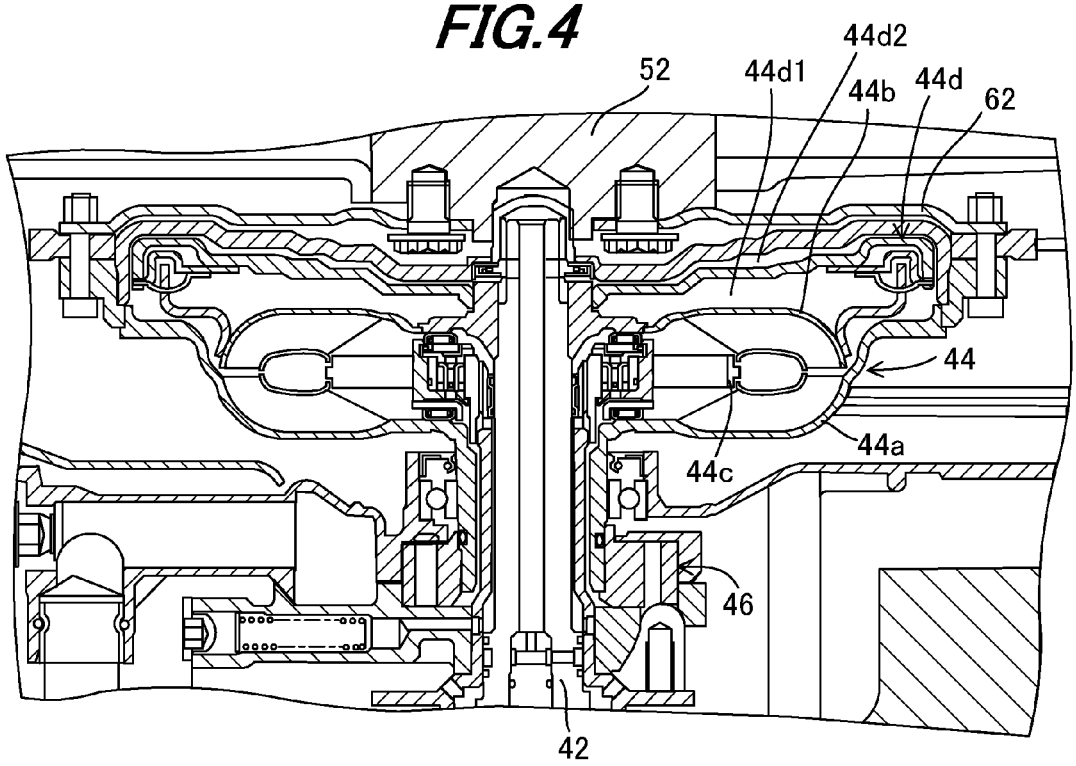
FIG. 4 is an enlarged sectional view showing a region around a torque converter shown in FIG. 2.

FIG. 4 is an enlarged sectional view showing a region around the torque converter 44 shown in FIG. 2.

As shown in FIG. 4, the torque converter 44 includes a pump impeller 44*a* connected to the crankshaft 52 through a drive plate 62, a turbine runner 44*b* that is installed to face the pump impeller 44*a* to receive/discharge the operating oil and connected to the drive shaft 42, a stator 44*c* installed between the pump impeller 44*a* and turbine runner 44*b*, a lockup clutch 44*d* and other components.

Figure 5:
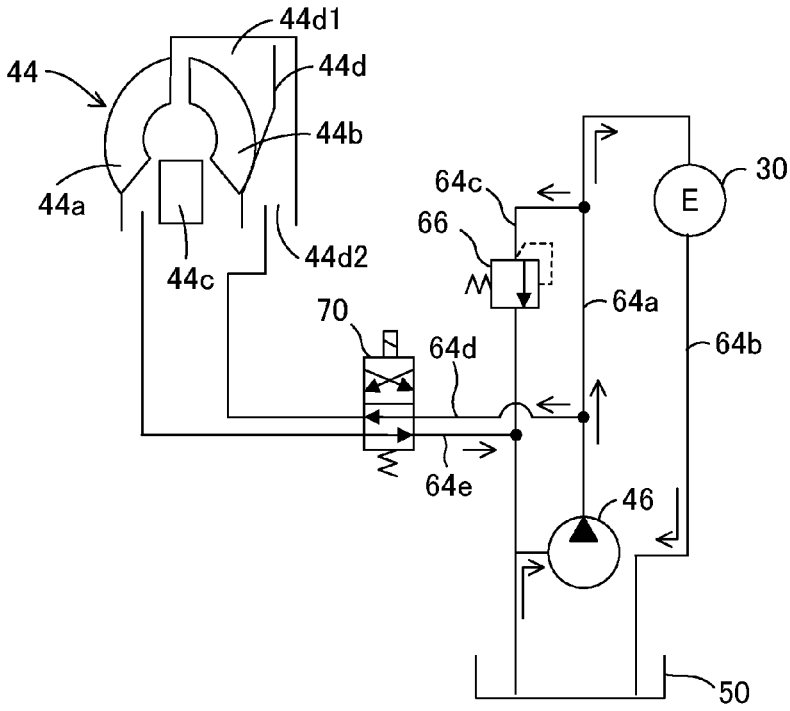
FIG. 5 is a hydraulic circuit diagram schematically showing the torque converter, a hydraulic pump and other components shown in FIG. 2.

FIG. 5 is a hydraulic circuit diagram schematically showing the torque converter 44, hydraulic pump 46, etc.

The hydraulic pump 46 driven by the engine 30 pumps up the operating oil in the reservoir 50 and forwards it to a first oil passage 64*a*. The pressurized operating oil forwarded to the first oil passage 64*a* is supplied to the lubricated portion of the engine 30 or the like and then returns to the reservoir 50 through a second oil passage 64*b*.

The first oil passage 64*a* is provided with a third oil passage 64*c* connecting the first oil passage 64*a* with an intake hole of the hydraulic pump 46. The third oil passage 64*c* is interposed with a relief valve 66 that opens when the pressure of the operating oil supplied to the engine 30 is at or above a defined value and closes when it is below the defined value.

A fourth oil passage 64*d* for circulating the operating oil supplied to the torque converter 44 is connected to the first oil passage 64*a* at a point between a discharge hole of the hydraulic pump 46 and a branch point of the first and third oil passages 64*a*, 64*c*. A fifth oil passage 64*e* for circulating the operating oil returning from the torque converter 44 to the hydraulic pump 46 is connected to the third oil passage 64*c* at a location downstream of the relief valve 66. The fourth and fifth oil passages 64*d*, 64*e* are installed with a lockup control valve 70 for controlling the operation of the lockup clutch 44*d*.

The lockup control valve 70 is a solenoid valve. The output of the valve 70 is connected to a piston chamber 44*d*1 of the lockup clutch 44*d* of the torque converter 44, and also connected to a chamber (rear chamber) 44*d*2 disposed in the rear of the piston chamber 44*d*1. The lockup control valve 70 switches the oil passage upon being magnetized/demagnetized, thereby controlling the ON/OFF state (engagement/release) of the lockup clutch 44*d*.

Specifically, when the lockup control valve 70 is magnetized, the operating oil is supplied to the piston chamber 44*d*1 and discharged from the rear chamber 44*d*2 so as to make the lockup clutch 44*d* ON (engaged), and when the valve 70 is demagnetized (the status in FIG. 5; initial condition), the operating oil is supplied to the rear chamber 44*d*2 and discharged from the piston chamber 44*d*1 so as to make the lockup clutch 44*d* OFF (released). Since the details of the aforementioned torque converter 44 is disclosed in '498, further explanation is omitted here.

The explanation of FIG. 2 will be resumed. The shift mechanism 54 comprises a forward bevel gear 54*a* and reverse bevel gear 54*b* which are connected to the drive shaft 42 to be rotated, a clutch 54*c* which can engage the propeller shaft 56 with either one of the forward bevel gear 54*a* and reverse bevel gear 54*b*, and other components.

The interior of the engine cover 32 is disposed with an electric shift motor (actuator) 72 that drives the shift mechanism 54. The output shaft of the shift motor 72 can be connected via a speed reduction gear mechanism (not shown) with the upper end of a shift rod 54*d* of the shift mechanism 54. Therefore, when the shift motor 72 is operated, its output appropriately displaces the shift rod 54*d* and a shift slider 54*e* to move the clutch 54*c* to one shift position from among a forward position, reverse position and neutral position.

When the shift position is forward or reverse, the rotational output of the drive shaft 42 is transmitted via the shift mechanism 54 to the propeller shaft 56 to rotate the propeller 60 in one of the directions making the boat 12 move forward or rearward. The outboard motor 10 is equipped with a power source (not shown) such as a battery or the like attached to the engine 30 to supply operating power to the motors 24, 40, 72, etc.

The outboard motor 10 is further equipped with a water pump 74 connected to the drive shaft 42 for cooling the engine 30. The water pump 74 driven by the drive shaft 42 pumps up cooling water (i.e., seawater or freshwater) through a cooling water intake (not shown) and forwards it to the engine 30 so that the water is circulated along cooled portions such as a region near a cylinder.

As shown in FIG. 3, a throttle opening sensor 80 is installed near the throttle valve 38 and produces an output or signal indicative of opening of the throttle valve 38, i.e., throttle opening TH. A shift position sensor 82 installed near the shift rod 54*d* produces an output or signal corresponding to a shift position (neutral, forward or reverse) and a neutral switch 84 also installed near the shift rod 54*d* produces an ON signal when the shift position is neutral and an OFF signal when it is forward or reverse.

A crank angle sensor (input rotation speed detector) 86 is installed near the crankshaft 52 of the engine 30 and produces a pulse signal at every predetermined crank angle. A drive shaft rotation speed sensor (output rotation speed detector) 90 is installed near the drive shaft 42 and produces an output or signal indicative of rotation speed of the drive shaft 42.

The outputs of the foregoing sensors and switch are sent to an Electronic Control Unit (ECU) 94 disposed in the outboard motor 10. The ECU 94 has a microcomputer including a CPU, ROM, RAM and other devices and installed in the engine cover 32 of the outboard motor 10.

As shown in FIG. 1, a steering wheel 102 is installed near a cockpit (the operator's seat) 100 of the boat 12 to be manipulated or rotated by the operator. A steering angle sensor 104 installed near a shaft (not shown) of the steering wheel 102 produces an output or signal corresponding to the steering angle of the steering wheel 102.

A remote control box 106 provided near the cockpit 100 is equipped with a shift/throttle lever 110 installed to be manipulated by the operator. Upon manipulation, the lever 110 can be swung in the front-back direction from the initial position and is used by the operator to input a shift position change command and engine speed regulation command. A lever position sensor 112 is installed in the remote control box 106 and produces an output or signal corresponding to a position of the lever 110. The outputs of the sensors 104, 112 are also sent to the ECU 94.

Based on the inputted outputs, the ECU 94 controls the operations of the motors and ON/OFF state of the lockup clutch 44*d* of the torque converter 44.

Figure 6:
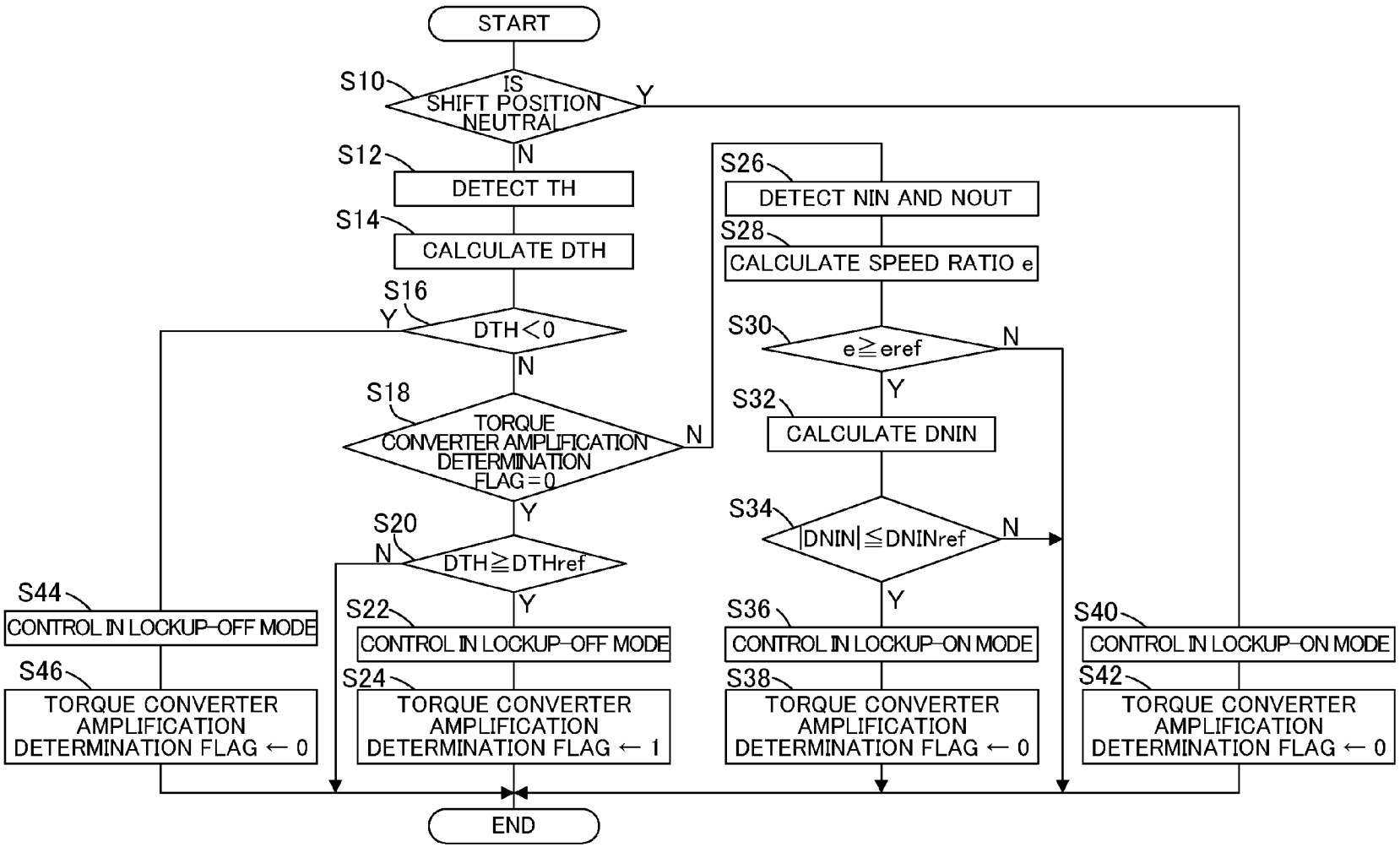
FIG. 6 is a flowchart showing the control of ON/OFF state of a lockup clutch of the torque converter shown in FIG. 1, etc.

FIG. 6 is a flowchart showing the control of ON/OFF state of the lockup clutch 44*d*. The illustrated program is executed by the ECU 94 at a predetermined interval, e.g., 100 milliseconds.

The program begins in S10, in which it is determined whether the shift mechanism 54 is set at the neutral position, i.e., the shift position is neutral. This determination is made by checking as to whether the neutral switch 84 outputs the ON signal. When the result in S10 is negative, the program proceeds to S12, in which the throttle opening TH is detected or calculated from the output of the throttle opening sensor 80 and to S14, in which a change amount (variation) DTH of the detected throttle opening TH per a predetermined time (e.g., 500 milliseconds) is calculated.

The program proceeds to S16, in which it is determined whether the engine 30 is in a decelerating condition. The determination in S16 whether the engine 30 (precisely, the boat 12) is decelerating is made by checking as to whether the change amount DTH of the throttle opening TH is less than 0 degree. In other words, when the change amount DTH is a negative value, the engine 30 is determined to be decelerating and when the change amount DTH is 0 or a positive value, it is determined to be at a constant speed or accelerating.

When the result in S16 is negative, the program proceeds to S18, in which it is determined whether a bit of an amplification determination flag of the torque converter 44 (torque converter amplification determination flag) is 0. As explained below, the bit of this flag is set to 1 when a condition where the output torque of the engine 30 is amplified through the torque converter 44 and transmitted to the drive shaft 42 (i.e., where the operation of the outboard motor 10 is in a range (torque amplification range) that the torque is to be amplified by the torque converter 44 to accelerate the boat 12) is established, and reset to 0 when the output torque of the engine 30 is not amplified (i.e., the operation of the outboard motor 10 is out of the torque amplification range).

Since the initial value of the bit of the torque converter amplification determination flag is 0, the result in S18 in the first program loop is generally affirmative and the program proceeds to S20, in which it is determined whether the engine 30 is in an accelerating condition. Specifically, the calculated change amount DTH of the throttle opening TH is compared with a throttle predetermined value (threshold value) DTHref and, when the change amount DTH is equal to or greater than the predetermined value DTHref, the engine 30 is determined to be in the accelerating condition. The predetermined value DTHref is set to a value (e.g., 0.5 degree) enabling to determine whether the engine 30 is accelerating.

When the result in S20 is negative, i.e., the engine 30 is neither decelerating nor accelerating but the boat 12 cruises at a constant speed, the remaining steps are skipped and when the result is affirmative, the program proceeds to S22, in which the torque converter 44 is controlled in a lockup-OFF mode. The lockup-OFF mode demagnetizes the lockup control valve 70 to make the lockup clutch 44*d* OFF. As a result, the output torque of the engine 30 is amplified by the torque converter 44 and transmitted to the drive shaft 42, thereby improving acceleration performance.

The program proceeds to S24, in which a bit of the torque converter amplification determination flag is set to 1 and the present program loop is terminated. Since the bit of this flag is set to 1, the result in S18 in the next and subsequent loops is negative and the program proceeds to S26. In other words, when the outboard motor 10 is in the condition where the output torque of the engine 30 is amplified by the torque converter 44 to accelerate the boat 12, the program proceeds to S26 onward.

In S26, an input rotation speed NIN and output rotation speed NOUT of the torque converter 44 are detected or calculated. Since the input rotation speed NIN is identical with the engine speed because the input side of the torque converter 44 is connected to the crankshaft 52 of the engine 30, it is detected by counting the output pulses of the crank angle sensor 86. The output rotation speed NOUT is detected from the output of the drive shaft rotation speed sensor 90.

The program proceeds to S28, in which a speed ratio e of the torque converter 44 is calculated based on the input rotation speed NIN and output rotation speed NOUT. The speed ratio e is a value obtained by dividing the output rotation speed NOUT by the input rotation speed NIN as shown in the following equation.

$$\text{Speed ratio } e = (\text{Output rotation speed } N\text{OUT})/(\text{Input rotation speed } N\text{IN})$$

The program proceeds to S30, in which it is determined whether the torque amplification range is ended, precisely, whether the torque amplification range (acceleration range) is saturated and the acceleration is completed. Specifically, the calculated speed ratio e is compared with a reference value (threshold value) eref to determine whether the speed ratio e is equal to or greater than the reference value eref, and when the result is affirmative, it is determined that the torque amplification range is ended. The reference value eref is set to a value (e.g., 0.8) enabling to determine whether the torque amplification range is ended.

When the result in S30 is affirmative, the program proceeds to S32, in which a change amount DNIN of the input rotation speed NIN (i.e., a change amount (variation) of the engine speed) is calculated. The change amount DNIN is obtained by subtracting the input rotation speed NIN detected in the present program loop from that detected in the previous program loop.

The program proceeds to S34, in which it is determined whether the speed of the boat 12 remains stable at the maximum speed or thereabout after completing acceleration. This determination is made by comparing an absolute value of the calculated change amount DNIN with a prescribed value (threshold value) DNINref to determine whether the absolute value is equal to or less than the prescribed value DNINref, and when the result is affirmative, determining that the speed of the boat 12 is stable at the maximum value or thereabout. The prescribed value DNINref is set to a value (e.g., 500 rpm) enabling to determine whether the speed of the boat 12 remains stable at the maximum value or thereabout after completing acceleration, specifically, the change amount DNIN is relatively small.

When the result in S34 is affirmative, the program proceeds to S36, in which the torque converter 44 is controlled in a lockup-ON mode. The lockup-ON mode magnetizes the lockup control valve 70 to make the lockup clutch 44*d* ON. As a result, since the crankshaft 52 of the engine 30 and the drive shaft 42 are directly connected, the boat 12 can reach the maximum speed (in a range of the engine performance) without slippage or the like of the torque converter 44, thereby improving speed performance.

Thus, when the speed ratio e is equal to or greater than the reference value eref and the change amount DNIN is equal to or less than the prescribed value DNINref, the lockup clutch 44*d* is made ON. Following to the process of S36, the program proceeds to S38, in which the bit of the torque converter amplification determination flag is reset to 0.

When the result in S30 or S34 is negative, since it means that the torque amplification range is not ended or saturated, or the speed of the boat 12 does not become stable at the maximum speed or thereabout, the process of S36, S38, etc., is skipped and the program is terminated.

When the result in S10 is affirmative, i.e., the shift position is neutral, the program proceeds to S40, in which the torque converter 44 is controlled in the lockup-ON mode and the lockup clutch 44*d* is made ON.

Specifically, the crankshaft 52 is directly connected to the drive shaft 42 to amplify the rotation speed of the drive shaft 42 such that the operation speed of the water pump 74 driven thereby is increased. Owing to this configuration, even when the shift position is neutral, the water pump 74 can be operated at the speed sufficient for cooling the engine 30, thereby improving cooling performance. Following to the process of S40, the bit of the torque converter amplification determination flag is reset to 0 in S42.

When the result in S16 is affirmative, i.e., the engine 30 is in the decelerating condition, the program proceeds to S44, in which the torque converter 44 is controlled in the lockup-OFF mode, i.e., the lockup clutch 44*d* is made OFF.

As a result, when the boat 12 cruises at the maximum speed after the lockup clutch 44*d* is made ON, if the engine speed is decreased, the lockup clutch 44*d* is made OFF, i.e., the engine 30 and drive shaft 42 are made disconnected. Therefore, the rotation speed of the drive shaft 42 is promptly decreased with decreasing engine speed, whereby the speed of the boat 12 can be efficiently decreased to a desired speed.

After the process of S44, the program proceeds to S46, in which the bit of the torque converter amplification determination flag is reset to 0 and the program is terminated.

As stated above, this embodiment is configured to have an apparatus for (and a method of) controlling an outboard motor (10) mounted on a stern of a boat (12) and having an internal combustion engine (30) to power a propeller (60), a drive shaft (42) that connects the engine and the propeller, a torque converter (44) that is interposed between the engine and the drive shaft and is equipped with a lockup clutch (44*d*), a water pump (74) that is connected to the drive shaft to be driven by the drive shaft, and a shift mechanism (54) interposed between the drive shaft and the propeller, comprising a neutral position detector (neutral switch 84, ECU 94, S10) that detects the shift mechanism being set in a neutral position; and a clutch ON unit (ECU 94, S40) that makes the lockup clutch ON to increase operation speed of the water pump when it is detected that the shift mechanism is set in the neutral position. With this, even when the shift mechanism 54 is set at the neutral position, the water pump 74 can be operated at the speed sufficient for cooling the engine 30, thereby improving cooling performance and preventing a defect such as overheat of the engine 30.

The apparatus further includes an input rotation speed detector (crank angle sensor 86, ECU 94, S26) that detects input rotation speed (NIN) of the torque converter, an output rotation speed detector (drive shaft rotation speed sensor 90, ECU 94, S26) that detects output rotation speed (NOUT) of the torque converter; a speed ratio calculator (ECU 94, S28) that calculates a speed ratio (e) of the torque converter based on the detected input rotation speed and the detected output rotation speed; an input rotation speed change amount calculator (ECU 94, S32) that calculates a change amount (DNIN) of the input rotation speed; a first determiner (ECU 94, S30) that compares the speed ratio with a reference value (eref) and determines whether the speed ratio is equal to or greater than the reference value; and a second determiner (ECU 94, S34) that compares the change amount of the input rotation speed with a prescribed value (DNINref) and determines whether the change amount is equal to or less than the prescribed value, and the clutch ON unit makes the lockup clutch ON when the speed ratio is equal to or greater than the reference value and the change amount is equal to or less than the prescribed value (S36).

With this, it becomes possible to accurately detect the time when torque amplification by the torque converter 44 is ended and, since the lockup clutch 44*d* is made ON under the condition, speed performance can be improved. Specifically, since it is configured to detect that the boat 12 cruises at the maximum speed or thereabout after the torque amplification range is ended and acceleration is completed based on the speed ratio e and the change amount DNIN, and make the lockup clutch 44*d* ON in response thereto, it becomes possible to make the lockup clutch 44*d* ON immediately after completing acceleration and the boat 12 can reach the maximum speed without slippage of the torque converter 44, thereby improving speed performance. Also, it leads to the improvement in fuel efficiency.

In the apparatus, the reference value is a value enabling to determine whether a torque amplification range is ended (S30). With this, it becomes possible to accurately detect that the torque amplification range is saturated and the acceleration is completed, and the lockup clutch 44*d* can be made ON under the detected condition, thereby further improving speed performance.

In the apparatus, the prescribed value is a value enabling to determine whether speed of the boat remains stable at maximum value or thereabout (S34). With this, the lockup clutch 44*d* can be made ON when the boat cruises at the maximum speed or thereabout after completing acceleration. As a result, the boat speed can reach the maximum speed while preventing slippage of the torque converter 44, thereby further improving speed performance and fuel efficiency.

The apparatus further includes a decelerating condition determiner (ECU 94, S16) that determines whether the engine is in a decelerating condition; and a clutch OFF unit (ECU 94, S44) that makes the lockup clutch OFF when the engine is in the accelerating condition. With this, the rotation speed (NOUT) of the drive shaft 42 is promptly decreased with decreasing engine speed, whereby the speed of the boat 12 can be efficiently decreased to a desired speed.

The apparatus further includes a throttle opening change amount calculator (throttle opening sensor 80, ECU 94, S14) that calculates a change amount (DTH) of throttle opening (TH) of a throttle valve (38) of the engine, and the decelerating condition determiner determines that the engine is in the decelerating condition when the change amount of the throttle opening is a negative value (S16). With this, it becomes possible to accurately detect that the engine 30 is in the decelerating condition.

It should be noted that, although the predetermined value eref, prescribed value DNINref, displacement of the engine 30 and other values are indicated with specific values in the foregoing, they are only examples and not limited thereto.

Japanese Patent Application No. 2008-270214 filed on Oct. 20, 2008 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump that is connected to the drive shaft to be driven by the drive shaft, and a shift mechanism interposed between the drive shaft and the propeller, comprising:

a neutral position detector that detects the shift mechanism being set in a neutral position;

a clutch ON unit that makes the lockup clutch ON to increase operation speed of the water pump when it is detected that the shift mechanism is set in the neutral position;

an input rotation speed detector that detects input rotation speed of the torque converter;

an output rotation speed detector that detects output rotation speed of the torque converter;

a speed ratio calculator that calculates a speed ratio of the torque converter based on the detected input rotation speed and the detected output rotation speed;

an input rotation speed change amount calculator that calculates a change amount of the input rotation speed;

a first determiner that compares the speed ratio with a reference value and determines whether the speed ratio is equal to or greater than the reference value; and a second determiner that compares the change amount of the input rotation speed with a prescribed value and determines whether the change amount is equal to or less than the prescribed value, and the clutch ON unit makes the lockup clutch ON when the speed ratio is equal to or greater than the reference value and the change amount is equal to or less than the prescribed value.

2. The apparatus according to claim 1, wherein the reference value is a value enabling to determine whether a torque amplification range is ended.

3. The apparatus according to claim 1, wherein the prescribed value is a value enabling a determination of whether the input rotation speed remains stable.

4. An apparatus for controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump that is connected to the drive shaft to be driven by the drive shaft, and a shift mechanism interposed between the drive shaft and the propeller, comprising:

a neutral position detector that detects the shift mechanism being set in a neutral position;

a clutch ON unit that makes the lockup clutch ON to increase operation speed of the water pump when it is detected that the shift mechanism is set in the neutral position;

a decelerating condition determiner that determines whether the engine is in a decelerating condition; and a clutch OFF unit that makes the lockup clutch OFF when the engine is in the accelerating condition.

5. The apparatus according to claim 4, further including:

a throttle opening change amount calculator that calculates a change amount of throttle opening of a throttle valve of the engine, and the decelerating condition determiner determines that the engine is in the decelerating condition when the change amount of the throttle opening is a negative value.

6. A method of controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump that is connected to the drive shaft to be driven by the drive shaft, and a shift mechanism interposed between the drive shaft and the propeller, comprising:

detecting the shift mechanism being set in a neutral position;

making the lockup clutch ON to increase operation speed of the water pump when it is detected that the shift mechanism is set in the neutral position;

detecting input rotation speed of the torque converter;

detecting output rotation speed of the torque converter;

calculating a speed ratio of the torque converter based on the detected input rotation speed and the detected output rotation speed;

calculating a change amount of the input rotation speed;

comparing the speed ratio with a reference value to determine whether the speed ratio is equal to or greater than the reference value; and comparing the change amount of the input rotation speed with a prescribed value to determine whether the change amount is equal to or less than the prescribed value, and the step of making makes the lockup clutch ON when the speed ratio is equal to or greater than the reference value and the change amount is equal to or less than the prescribed value.

7. The method according to claim 6, wherein the reference value is a value enabling to determine whether a torque amplification range is ended.

8. The method according to claim 6, wherein the prescribed value is a value enabling a determination of whether the input rotation speed remains stable.

9. A method of controlling an outboard motor mounted on a stern of a boat and having an internal combustion engine to power a propeller, a drive shaft that connects the engine and the propeller, a torque converter that is interposed between the engine and the drive shaft and is equipped with a lockup clutch, a water pump that is connected to the drive shaft to be driven by the drive shaft, and a shift mechanism interposed between the drive shaft and the propeller, comprising:

detecting the shift mechanism being set in a neutral position;

making the lockup clutch ON to increase operation speed of the water pump when it is detected that the shift mechanism is set in the neutral position;

determining whether the engine is in a decelerating condition; and making the lockup clutch OFF when the engine is in the accelerating condition.

10. The method according to claim 9, further including a step of:

calculating a change amount of throttle opening of a throttle valve of the engine, and the step of determining determines that the engine is in the decelerating condition when the change amount of the throttle opening is a negative value.

11. The method according to claim 6, wherein the step of detecting the shift mechanism being set in the neutral position is based on an output signal of a shift position sensor corresponding to a shift position of the shift mechanism being in the neutral position, wherein the shift mechanism includes at least a forward bevel gear, a reverse bevel gear, and a clutch such that the shift position of the shift mechanism is switchable between a forward position, a reverse position, and the neutral position, and wherein the output signal of the shift position sensor is configured to identify whether the shift position of the shift mechanism is the forward position, the reverse position, or the neutral position.

12. The apparatus according to claim 1, wherein the shift mechanism includes at least a forward bevel gear, a reverse bevel gear, and a clutch such that a shift position of the shift mechanism is switchable between a forward position, a reverse position, and the neutral position.

13. The apparatus according to claim 12, further comprising a shift position sensor configured to output a signal corresponding to the shift position of the shift mechanism, wherein the neutral position detector detects the shift mechanism being in the neutral position based on the output signal of the shift position sensor corresponding to the neutral position.

* * * * *